United States Patent [19]

Murphy

[11] 4,262,324

[45] Apr. 14, 1981

[54] ORNAMENTAL NECKWEAR

[76] Inventor: Hermine Murphy, 923 Fifth Ave., New York, N.Y. 10021

[21] Appl. No.: 71,286

[22] Filed: Aug. 30, 1979

[51] Int. Cl.[3] ..... F21L 15/08; F21L 15/14

[52] U.S. Cl. ..... 362/104; 362/108; 362/196; 362/226; 362/394

[58] Field of Search ..... 362/103, 104, 105, 106, 362/107, 108, 196, 226, 394; 200/51 R; 339/91 R

[56] References Cited

U.S. PATENT DOCUMENTS

| | | | |
|---|---|---|---|
| D. 251,629 | 4/1979 | Nelson | D26/87 |
| 1,402,609 | 1/1922 | Houdous | 362/103 |
| 1,438,531 | 12/1922 | Keller | 362/196 |
| 1,623,002 | 3/1927 | Gossett | 362/103 |
| 2,430,607 | 11/1947 | Gaskouitz | 362/103 |
| 3,112,889 | 12/1963 | Marmo | 362/103 |
| 3,360,763 | 12/1967 | Rongey | 339/91 R |
| 3,383,503 | 5/1968 | Montgomery | 362/104 |
| 3,433,939 | 3/1969 | Lothman | 362/226 |
| 4,096,552 | 6/1978 | Ben-Porat | 362/104 |
| 4,099,222 | 7/1978 | Cornell | 362/226 |
| 4,101,955 | 7/1978 | DuNah | 362/104 |

*Primary Examiner*—David H. Brown
*Assistant Examiner*—Edward F. Miles
*Attorney, Agent, or Firm*—Kane, Dalsimer, Kane, Sullivan and Kurucz

[57] ABSTRACT

Disclosed herewith is a new necklace pendant combination of illuminated jewelry.

5 Claims, 5 Drawing Figures

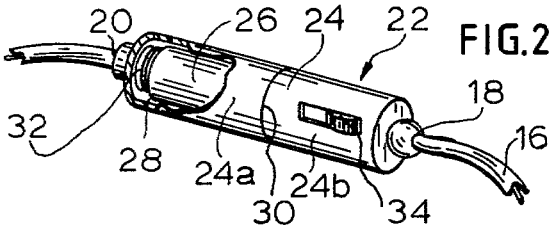
FIG.2
FIG.1
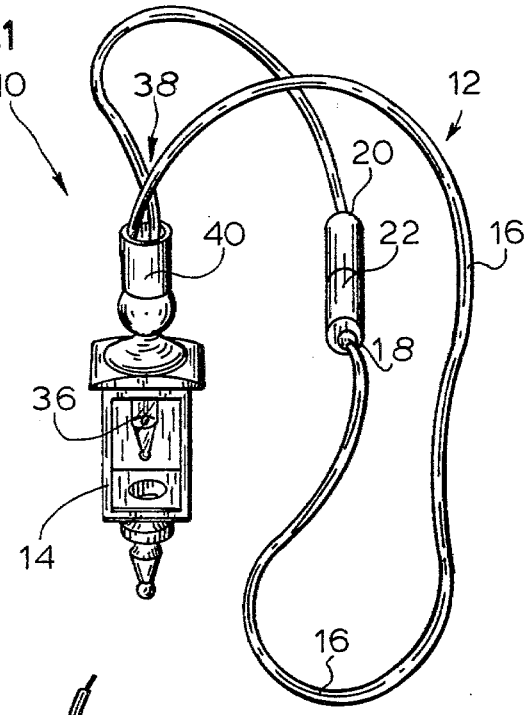
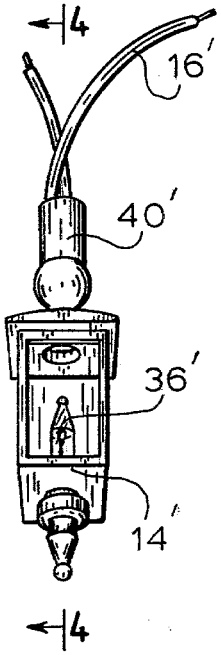
FIG.3
FIG.4
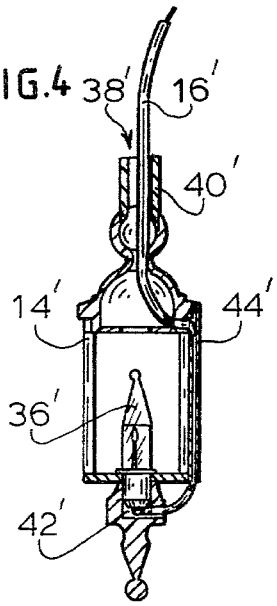
FIG.5
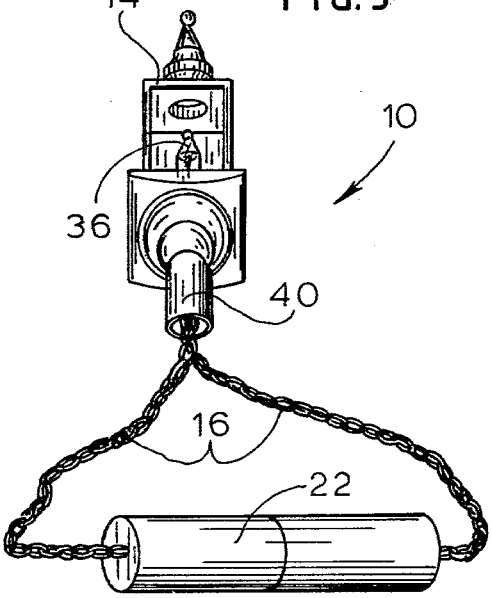

ORNAMENTAL NECKWEAR

BACKGROUND OF THE INVENTION

1. Field of the Invention

The invention relates to ornamental neckwear and more particularly relates to an illuminated necklace-pendant combination supported on the neck of a human.

2. Brief Description of the Prior Art

Illuminated jewelry has previously been described in the literature. Representative of such disclosures are those found in U.S. Pat. No. Des. 251,629; U.S. Pat. Nos. 3,450,872; 3,689,758; and 4,101,955. In general prior art jewelry neckwear which includes a means for illumination has not been completely satisfactory from an aesthetic viewpoint. The prior art articles are generally bulky, include cumbersome power source components and are not aesthetically appealing. The present invention is an improvement in these respects and provides an attractive article of neckwear which may be proudly exhibited and worn on all occasions.

In addition to its usefullness as an article of adornment, the invention is a safety device providing a personal signal or caution light for the wearer, particularly as a pedestrian.

SUMMARY OF THE INVENTION

The invention comprises

An ornamental article of neckwear, which comprises;

(a) a necklace including (i) an elongate, electrical conductor having a first end, a second end and a continuous flexible, body joining said first and second ends;

(ii) an electric current producing dry cell having a positive pole and a negative pole;

(iii) electrical connector means removably joining the first end of the conductor to the positive pole;

(iv) electrical connector means removably joining the second end of the conductor to the negative pole; and (b) a pendant supported on the necklace body and including (i) a miniature replica of a lighting fixture;

(ii) an incandescent electrical lamp adapted to be mounted in said fixture and mounted in said fixture; and (iii) electrical connector means connecting the lamp electrically to the body of the electrical conductor;

whereby the lamp is powered by electrical current distributed by the dry cell through the necklace conductor body, said necklace (a) and said lamp (b) (ii) with connector means (b) (iii) forming an electrical circuit.

BRIEF DESCRIPTION OF THE DRAWINGS

FIG. 1 is a view-in-perspective of an embodiment article of the invention;

FIG. 2 is an enlarged view, partially cut-away, of the power source component of the embodiment article shown in FIG. 1;

FIG. 3 is a view-in-perspective of an alternate embodiment pendant component of an article of the invention;

FIG. 4 is a cross-sectional side view along lines 4—4 of FIG. 3; and

FIG. 5 is a view-in-perspective of another embodiment article of the invention.

DETAILED DESCRIPTION OF THE PREFERRED EMBODIMENTS OF THE INVENTION

In FIG. 1 there is shown in a perspective view an article 10 of the invention which comprises a necklace component 12 and a pendant component 14 supported on the necklace 12. The necklace 12 comprises an elongate electrical conductor 16 having a first end 18 and a second end 20. The body of conductor 16 joining the ends 18, 20 is a continuous, flexible, conductive wire covered with an aesthetically acceptable, insulative, textile fabric. The fabric serves to both insulate the conductive wire and to provide a decorative, "dressy" look. The length of conductor 16 may be predetermined and selected to allow for supporting the pendant 14 at any desired height from the neck of the wearer.

Included in necklace 12 as an integral part thereof is a power pack 22. Referring now to FIG. 2, power pack 22 may be seen in greater detail, partially cut-away. Power pack 22 includes a tubular dry cell or battery holder 24 which holds and contains a dry cell power source 26. The dry cell 26 may be any conventional dry cell, preferably of the AA size "penlite" battery providing 1.5 volts of electrical current. Any other conventional battery may be used including the so-called "mercury battery" and the holder 24 shape and size will be selected so as to hold an operative battery. The dry cell 26 has a positive pole (not seen in FIG. 2) which makes electrical connection with the end 18 of conductor 16. The negative pole 28 of dry cell 26 is connected with end 20 of conductor 16 through the means of a contact 32 soldered to the body of the holder 24 and to the wire core of conductor 16. Although not shown in FIG. 2, the end 18 of conductor 16 may be similarly joined to the positive pole of dry cell 26 through soldered contact means to permit the transfer of electrical current. These electrical connector means joining ends 18, 20 of conductor 16 to the opposite poles of dry cell 26 are removably connected from the dry cell poles by separation of the holder 24 into its component parts **24*a* and 24*b*. The holder 24 separates along joint 30 which may be a friction fitting joint, a threaded joint or any like conventional joinder means. By separation of the holder 24 into its separate component parts 24*a* and 24*b*, access to the dry cell 26 is obtained for battery replacement, the electrical circuit through conductor 16 is interrupted and the necklace 12 is opened for placement or removal from the neck of a human. Those skilled in the art will appreciate that in this manner the battery pack 22 also functions as a clasp for necklace 12. This is a convenience allowing for a more compact article. An optional feature shown in FIG. 2 is an electrical switch 34 which may be used to open and close the electrical circuit in conductor 16 at its connection between end 18 and the positive pole of dry cell 26, without the need for disassembly of holder 24 into its component parts 24*a* and 24*b***.

Referring back to FIG. 1, it will be appreciated that pendant 14, supported on necklace 12, is a miniature replica of a common, decorative lighting fixture. Unlike many illuminated pendants of the prior art, pendant 14 is artfull and aesthetically acceptable even for formal dress. Mounted in the pendant 14 is an incandescent lamp 36 adapted by size and configuration to be tastefully mounted in the pendant 14. Preferably the lamp 36 has an electrical capacity to accept electrical energy from the dry cell 26 selected. The lamp 36 is connected electrically to the conductive portion of the electrical conductor 16 (not seen in FIG. 1) as well as receiving support therefrom through its mounting in the pendant 14. The textile fabric covering on conductor 16 is protected from damage at the point 38 of its association with pendant 14 by entry through a ferrule 40 mounted above the pendant 14. This ferrule 40 aids in reducing wear on the insulative fabric, which may also be doped along its length within ferrule 40 to resist unraveling.

FIG. 3 is a view-in-perspective of an alternate embodiment pendant 14' component of the neckwear articles of the invention. In FIG. 3, parts analogous to the parts of pendant 14 are similarly numbered but with the addition of a prime mark. The pendant 14' differs structurally from the pendant 14 in that the lamp 36' component is mounted in the base of the replica of the lighting fixture rather than in the ceiling thereof. Referring now to FIG. 4, a cross-sectional view along lines 4—4 of FIG. 3, details of the mounting may be observed. Thus, lamp 36' is mounted in pendant 14' on a threaded socket 42' which is an electrical connector means for connecting lamp 36' to the electrical circuit of conductor 16'. The conductor 16' is looped through the ferrule 40' and soldered to socket 42'. A cover 44' conceals the conductor 16' where it passes from the top of the pendant 14' to the base socket 42' of the pendant. It will be appreciated that the electrical circuit through the necklace 12 and connected lamp 36 or 36' is a single, integrated circuit opened or closed through the means of the separation of the battery pack 22 (which acts as a clasp).

FIG. 5 is a view-in-perspective of another embodiment article of the invention 10' wherein all parts analogous to those found in the article 10 are numbered with like identifying numbers. The article 10' differs from article 10 in that the conductor 16 is a metallic, link chain instead of an insulated wire. Although it is preferred to insulate the conductor 16, the low voltage (1.5 volt) circuit permits use of an uninsulated chain. The advantage of an uninsulated chain resides in its aesthetic appearance, and the warming effect obtained by resistance of electrical current in its passage through the conductive chain.

The neckwear articles 10 and 10' described above operate as follows. With the battery holder 22 separated into its component halves **24*a* and 24*b*, no electrical current passes from battery 26 to the lamp 36 or 36'. The wearer then arranges the article 10 or 10' around the neck and closes the circuit in conductor 16 or 16' by securing the halves 24*a* and 24*b* together. This secures the necklace 12 about the wearer's neck and electrically activates lamp 36 or 36' by closing the electrical circuit. By separating the holder 22 parts 24*a* and 24*b*, the necklace is unsecured and the electrical circuit powering lamp 36 or 36'** is interrupted.

Those skilled in the art will appreciate that many modifications of the above described preferred embodiments may be made without departing from the spirit and the scope of the invention. For example, miniature replica lighting fixtures of other designs may be used in place of pendants 14 and 14'.

I claim:

1. An ornamental article of neckwear, which comprises;

(a) a necklace including (i) an elongate, electrical conductor having a first end, a second end and a continuous, flexible, body joining said first and second ends;

(ii) an electric current producing dry cell having a positive pole and a negative pole;

(iii) electrical connector means removably joining the first end of the conductor to the positive pole;

(iv) electrical connector means removably joining the second end of the conductor to the negative pole;

(v) joinder means on each of said electrical connector means (iii) and (iv) for removably joining the electrical connector means (iii) to the electrical connector means (iv);

said electrical connector means (iii) and (iv) when joined together by joinder means (v) forming (1) a battery holder which holds and contains the electric current producing dry cell;

(2) an electrical connector in a series electrical circuit; and (3) an openable link in said necklace; and (b) a pendant supported on the necklace body and including (i) a miniature replica of a lighting fixture;

(ii) an incandescent electrical lamp adapted to be mounted in said fixture and mounted in said fixture; and (iii) electrical connector means connecting the lamp electrically to the body of the electrical conductor;

whereby the lamp is powered by electrical current distributed by the dry cell through the necklace conductor body, said necklace (a) and said lamp (b) (ii) with connector means (b) (iii) forming an electrical circuit.

2. The article of claim 1, wherein said conductor is a continuous, metal chain.

3. The article of claim 1, wherein said conductor is a metal filament covered with an electrically insulative fabric.

4. The article of claim 1, wherein said necklace further includes an electrical switch means located in the circuit between the positive and negative poles whereby the electrical circuit may be selectively closed and opened to light and extinguish the lamp.

5. The article of claim 1, wherein said lamp is removably mounted.

* * * * *